US009277784B1

(12) United States Patent
Lawson

(10) Patent No.: US 9,277,784 B1
(45) Date of Patent: Mar. 8, 2016

(54) FOOTWEAR SYSTEM

(71) Applicant: Donna L. Lawson, Tampa, FL (US)

(72) Inventor: Donna L. Lawson, Tampa, FL (US)

( * ) Notice: Subject to any disclaimer, the term of this patent is extended or adjusted under 35 U.S.C. 154(b) by 202 days.

(21) Appl. No.: 13/916,100

(22) Filed: Jun. 12, 2013

Related U.S. Application Data

(63) Continuation-in-part of application No. 13/859,309, filed on Apr. 9, 2013, now abandoned.

(51) Int. Cl.
*A43B 17/00* (2006.01)
*A43B 13/38* (2006.01)

(52) U.S. Cl.
CPC ..... *A43B 13/386* (2013.01); *A43B 13/38* (2013.01); *A43B 17/00* (2013.01)

(58) Field of Classification Search
CPC ..... A43B 17/00; A43B 13/38; A43B 13/386; A43B 17/006
USPC ..... 36/11.5, 43, 44
See application file for complete search history.

(56) References Cited

U.S. PATENT DOCUMENTS

| | | | | | |
|---|---|---|---|---|---|
| 1,351,726 | A | * | 8/1920 | Story | 36/44 |
| 1,678,739 | A | * | 7/1928 | Small et al. | 36/44 |
| 2,495,045 | A | * | 1/1950 | Woodbury et al. | 36/44 |
| 2,932,097 | A | * | 4/1960 | George | 36/11.5 |
| 6,003,246 | A | * | 12/1999 | Pan | 36/11.5 |
| D590,587 | S | * | 4/2009 | Abbosh | D2/961 |
| D594,188 | S | * | 6/2009 | Christie | D2/917 |
| D609,896 | S | * | 2/2010 | Christie | D2/969 |

* cited by examiner

*Primary Examiner* — Marie Bays

(57) ABSTRACT

A pad having upper and lower surfaces. The pad has front, back, interior and exterior edges forming a pad periphery. The pad includes an aperture for coupling with foot wear. The pad includes indoor/outdoor carpet formed of a bottom layer of backing material and a top layer of pile. A binding strip around the pad periphery. The binding strip covers portions of the upper and lower surfaces of the pad. The pad also includes over-edge stitching extending downwardly through the binding strip, the carpet and the binding strip. An adhesive on the lower surface of the pad is for coupling to footwear.

7 Claims, 3 Drawing Sheets

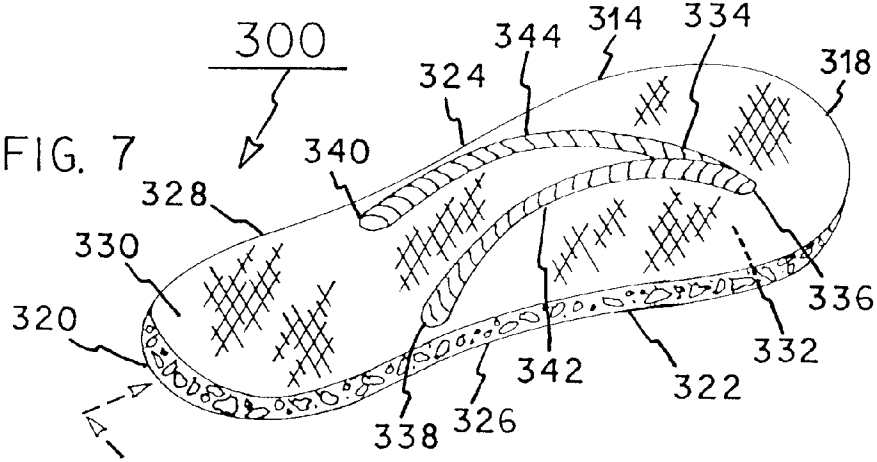
FIG. 7
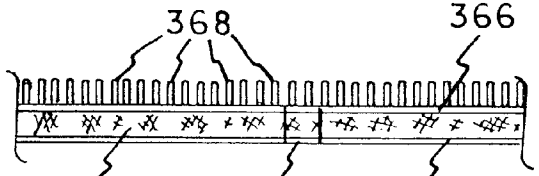
FIG. 8
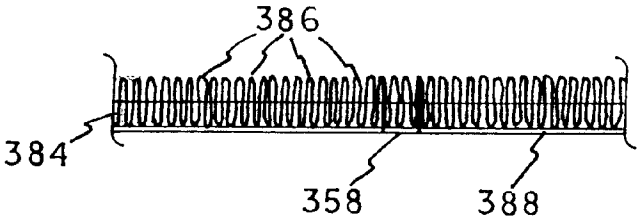
FIG. 8A
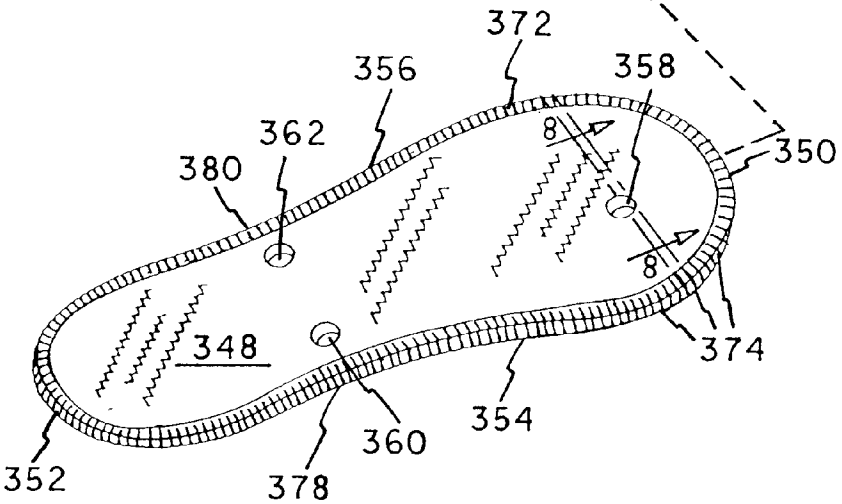

FOOTWEAR SYSTEM

RELATED APPLICATION

The present invention is a continuation-in-part of pending application Ser. No. 13/859,309 filed Apr. 9, 2013, the subject matter of which is incorporated herein by reference.

BACKGROUND OF THE INVENTION

1. Field of the Invention

The present invention relates to a footwear system and more particularly pertains to removably positioning and retaining padding upon upper surfaces of footwear soles for a wearer's sanitation and comfort, the positioning and retaining being done in a safe, convenient and economical manner.

2. Description of the Prior Art

The use of footwear systems of known designs and configurations is known in the prior art. More specifically, footwear systems of known designs and configurations previously devised and utilized for the purpose of removably positioning and retaining padding upon footwear soles are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a footwear system that allows for removably positioning and retaining padding upon upper surfaces of footwear soles for a wearer's sanitation and comfort, the positioning and retaining being done in a safe, convenient and economical manner.

In this respect, the footwear system according to the present invention substantially departs from the conventional concepts and designs of the prior art, and in doing so provides an apparatus primarily developed for the purpose of removably positioning and retaining padding upon upper surfaces of footwear soles for a wearer's sanitation and comfort, the positioning and retaining being done in a safe, convenient and economical manner.

Therefore, it can be appreciated that there exists a continuing need for a new and improved footwear system which can be used for removably positioning and retaining padding upon upper surfaces of footwear soles for a wearer's sanitation and comfort, the positioning and retaining being done in a safe, convenient and economical manner. In this regard, the present invention substantially fulfills this need.

SUMMARY OF THE INVENTION

In view of the foregoing disadvantages inherent in the known types of footwear systems of known designs and configurations now present in the prior art, the present invention provides an improved footwear system. As such, the general purpose of the present invention, which will be described subsequently in greater detail, is to provide a new and improved footwear system and method which has all the advantages of the prior art and none of the disadvantages.

To attain this, the present invention essentially comprises a pad having upper and lower surfaces. The pad has front, back, interior and exterior edges forming a pad periphery. The pad includes an aperture for coupling with foot wear. The pad includes indoor/outdoor carpet formed of a bottom layer of backing material and a top layer of pile. A binding strip around the pad periphery. The binding strip covers portions of the upper and lower surfaces of the pad. The pad also includes over-edge stitching extending downwardly through the binding strip, the carpet and the binding strip. An adhesive on the lower surface of the pad is for coupling to footwear.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved footwear system which has all of the advantages of the prior art footwear systems of known designs and configurations and none of the disadvantages.

It is another object of the present invention to provide a new and improved footwear system which may be easily and efficiently manufactured and marketed.

It is further object of the present invention to provide a new and improved footwear system which is of durable and reliable constructions.

An even further object of the present invention is to provide a new and improved footwear system which is susceptible of a low cost of manufacture with regard to both materials and labor, and which accordingly is then susceptible of low prices of sale to the consuming public, thereby making such footwear system economically available to the buying public.

Lastly, it is another object of the present invention is to provide a footwear system for positioning and retaining padding upon upper surfaces of footwear soles for a wearer's sanitation and comfort, the positioning and retaining being done in a safe, convenient and economical manner.

These together with other objects of the invention, along with the various features of novelty which characterize the invention, are pointed out with particularity in the claims annexed to and forming a part of this disclosure.

For a better understanding of the invention, as well as its operating advantages and the specific objects and advantage attained by its uses, reference should be had to the accompanying drawings and descriptive matter in which there is illustrated the preferred embodiment of the invention and an alternate embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an exploded perspective illustration similar to FIG. 1 but illustrating a final and preferred embodiment of the invention.

FIGS. 8 and 8A are cross sectional views of alternate embodiments taken along line 8-8 of FIG. 7.

The same reference numerals refer to the same parts throughout the various Figures.

DESCRIPTION OF THE PREFERRED EMBODIMENT

Figure 1:
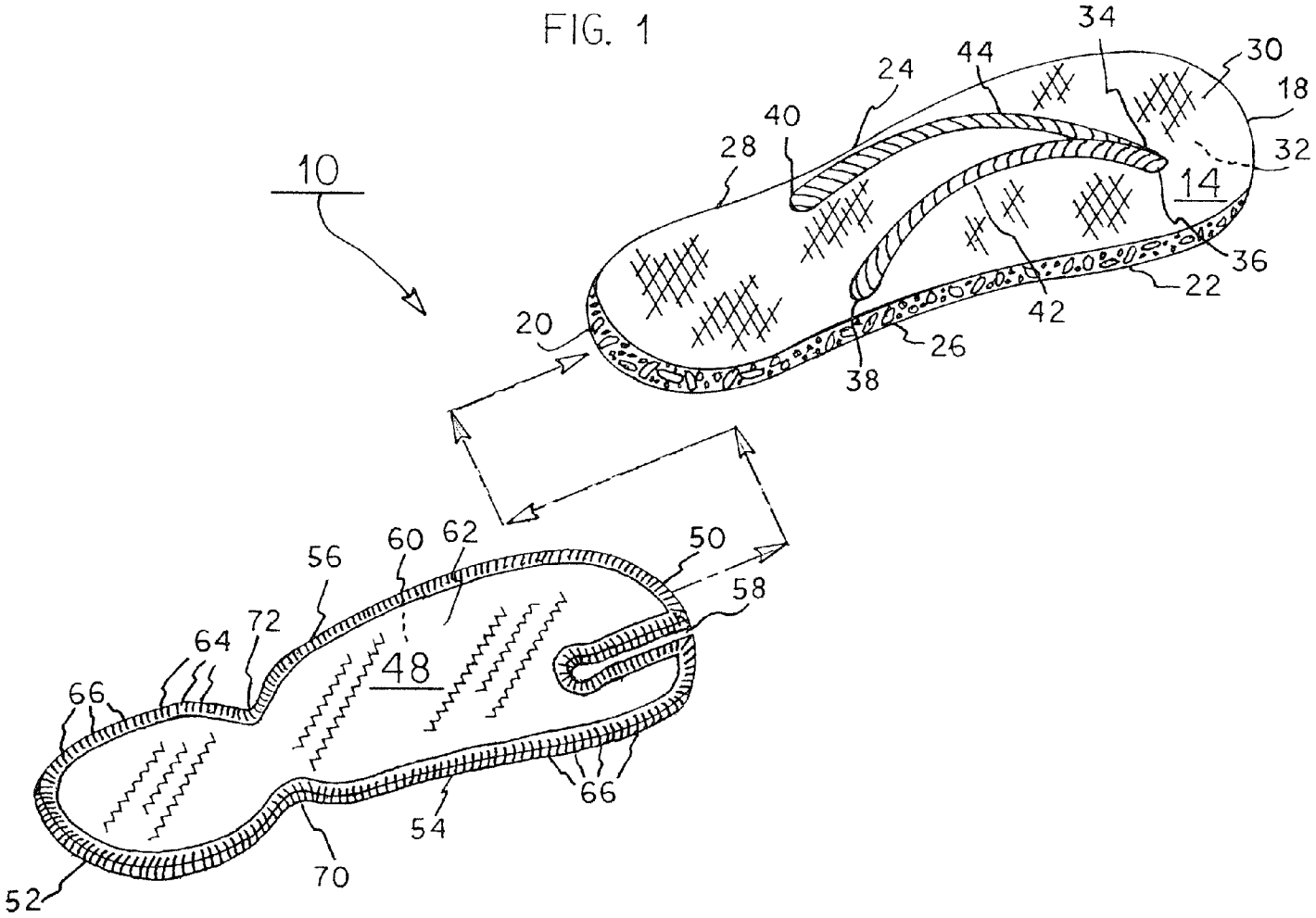
FIG. 1 is an exploded perspective illustration of a footwear system constructed in accordance with the principles of the present invention.
Figure 4:
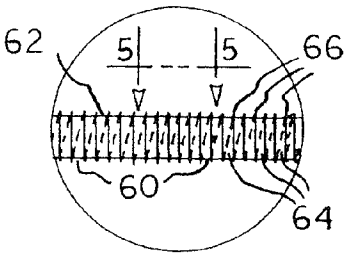
FIG. 4 is an enlarged illustration of part of the pad taken at the circle of FIG. 3.
Figure 5:
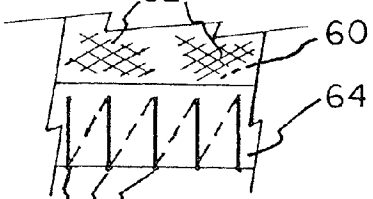
FIG. 5 is a plan view of a portion of the pad adjacent to the periphery taken along line 5-5 of FIG. 4.

With reference now to the drawings, and in particular to FIG. 1 thereof, the preferred embodiment of the new and improved footwear system embodying the principles and concepts of the present invention and generally designated by the reference numeral 10 will be described.

The present invention, the footwear system 10 is comprised of a plurality of components. In its broadest concept, the present invention is a pad having a notch and being positionable on the sole of footwear. Such components are individually configured and correlated with respect to each other so as to attain the desired objective.

The footwear system 10 is for removably positioning and retaining padding upon upper surfaces of footwear soles for a wearer's sanitation and comfort. The positioning and retaining are done in a safe, convenient and economical manner. First provided is a pair of soles. The soles include a left sole 14 and a similarly configured right sole (not shown). Each sole is fabricated of an elastomeric material chosen from the class of elastomeric materials including plastic and rubber, natural and synthetic, and blends thereof. Each sole has a front edge 18, a back edge 20, an interior edge 22, and an exterior edge 24. Each interior edge has a first curved minor recess 26 closer to the back edge than to the front edge with a first radius of curvature. Each exterior edge has a second curved minor recess 28 closer to the back edge than to the front edge with a second radius of curvature. The front, back, interior and exterior edges of each sole form a sole periphery. Each sole has an upper surface 30 and a lower surface 32.

Next provided is an upper 34 operatively coupled with respect to each sole. Each upper is formed of a forward junction 36 extending upwardly from the upper surface of the sole adjacent to the front edge, an inner junction 38 extending upwardly from the upper surface of the sole adjacent to the first recess, and an outer junction 40 extending upwardly from the upper surface of the sole adjacent to the second recess. The upper also includes a first strap 42 and a second strap 44. The first strap joins the front junction with the interior junction. The second strap joins the front junction with the exterior junction. The junctions and the straps are fabricated of an elastomeric material chosen from the class of elastomeric materials including plastic and rubber, natural and synthetic, and blends thereof.

Figure 6:
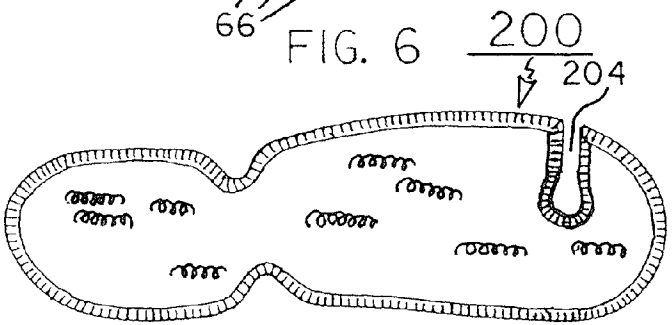
FIG. 6 is a plan view of a pad constructed in accordance with another alternate embodiment of the invention.
Figure 2:
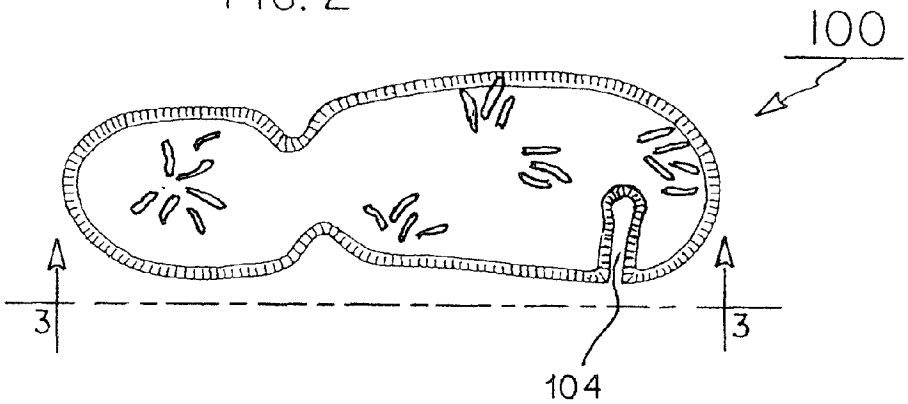
FIG. 2 is a plan view of a pad constructed in accordance with an alternate embodiment of the invention.
Figure 3:
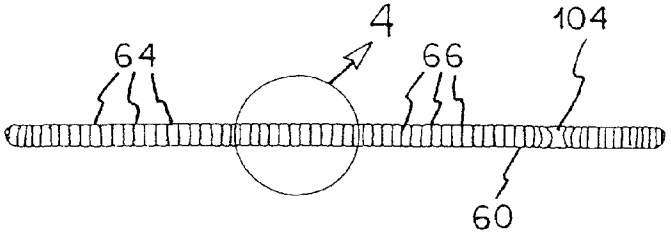
FIG. 3 is a side elevational view taken along line 3-3 of FIG. 2.

Lastly, a pad 48 is provided. The pad is removably positionable upon the upper surface of each sole. Each pad has a front edge 50 and a back edge 52 positionable over the front edge and back edge respectively of an associated sole. Each pad has an interior edge 54 and an exterior edge 56 positionable generally over the interior edge and exterior edge respectively of an associated sole, the front, the back, the interior and the exterior edges of each pad forming a pad periphery generally corresponding to the sole periphery. The sole periphery also includes a notch 58 extending rearwardly from the front edge of the pad. The notch is of a length essentially equal to the distance between the front edge of the footwear and the front junction. The notch has a width to receive the front junction. The sole includes a bottom layer 60 fabricated of burlap. The sole also includes a top layer 62 fabricated of pile carpet. In the preferred embodiment, shown in FIG. 1, medium pile carpet having a pile height from 0.5 centimeters to 1.5 centimeters is chosen. In an alternate embodiment of the system 100, as shown in FIG. 2, the pile is shag pile. In another embodiment of the system 200, as shown in FIG. 6, the pile is a short pile with a length not greater than 1.5 centimeters. A binding strip 64 of essentially inextensible material around the pad periphery includes the notch. The binding strip covers portions of the upper surface of the pad and portions of the lower surface of the pad. The pad also includes over-edge stitching 66 extending downwardly through the binding strip above, the carpet, and the binding strip below. The interior edge has a first curved major recess 70 adjacent to the interior junction with a third radius of curvature greater than the first radius of curvature. The exterior edge has a second curved major recess 72 adjacent to the exterior junction with a fourth radius of curvature greater than the second radius of curvature.

An alternate embodiment of the system 100 is shown in FIG. 2. In this embodiment, the notch 104 extends laterally from the interior edge and shag pile is illustrated.

Another alternate embodiment of the system 200 is shown in FIG. 6. In this embodiment, the notch 204 extends laterally from the exterior edge and a short pile with a length not greater than 1.5 centimeters is illustrated.

The final and preferred embodiment of the present invention is illustrated in FIGS. 7, 8 and 8A. Such embodiment is a footwear system 300 for permanently positioning and retaining pads upon upper surfaces of footwear soles for a wearer's sanitation and comfort. The positioning and retaining are done in a safe, convenient and economical manner. The system includes a pair of soles including a left sole 314 and a similarly configured right sole. Each sole is fabricated of an elastomeric material chosen from the class of elastomeric materials including plastic and rubber, natural and synthetic, and blend thereof. Each sole has a front edge 318, a back edge 320, an interior edge 322 and an exterior edge 324. Each interior edge has a first curved sole recess 326 closer to the back edge than to the front edge with a first radius of curvature. Each exterior edge has a second curved sole recess 328 closer to the back edge than to the front edge with a second radius of curvature. The front, back, interior and exterior edges of each sole form a sole periphery. Each sole has an upper surface 330 and a lower surface 332.

Next provided is an upper 334 operatively coupled with respect to each sole. Each upper is formed of a forward component 336 extending upwardly from the upper surface of the sole adjacent to the front edge. An inner component 338 extends upwardly from the upper surface of the sole adjacent to the first recess and an outer component 340 extending upwardly from the upper surface of the sole adjacent to the second recess. The upper also includes a first strap 342 and a second strap 344. The first strap joins the front component with the interior component. The second strap joins the front component with the exterior component. The components and the straps are fabricated of an elastomeric material chosen from the class of elastomeric materials including plastic and rubber, natural and synthetic, and blend thereof.

Next provided is a pad 348 fixedly positionable upon the upper surface of each sole. Each pad has a front edge 350 and a back edge 352 positionable over the front edge and back edge respectively of an associated sole. Each pad has an interior edge 354 and an exterior edge 356 positionable over the interior edge and exterior edge respectively of an associated sole. The front, back, interior and exterior edges of each pad form a pad periphery corresponding to the sole periphery. The pad is formed with a forward hole 358 adjacent to the front edge of the pad. The pad is formed with an interior hole 360 adjacent to the interior edge of the pad. The pad is formed with an exterior hole 362 adjacent to the exterior edge of the pad. Each hole has a diameter to receive the front, interior and exterior components.

The pad includes a bottom layer 364 woven of an inextensible synthetic fabric with a top layer 366 fabricated of plastic and upstanding piles 368. The piles have a pile height from 0.5 centimeters to 1.5 centimeters. A binding strip 372 of inextensible synthetic material is positioned around the pad periphery. The binding strip covers portions of the upper surface of the pad and portions of the lower surface of the pad. The pad also including over-edge stitching 374 extending downwardly through the binding strip, the carpet, and the binding strip. The interior edge has a first curved pad recess 378 adjacent to the interior component with a third radius of curvature equal to the first radius of curvature. The exterior edge has a second curved pad recess 380 adjacent to the exterior component with a fourth radius of curvature equal to the second radius of curvature.

Lastly provided is an adhesive 388. The adhesive is on the lower surface of the pad attaching the pad to the upper surface of the sole.

Although the present invention is illustrated as used with a flip-flop type of footwear with three holes in the upper surface and two straps, it should be understood that the system is adapted for use with a wide variety of footwear including, but not limited to, footwear with a single hole in the upper surface and lateral side attachment points.

Indoor/outdoor carpet can be categorized according to the pile. It comes in a variety of colors, thickness, grades, styles and quality including berber, loop and plush. Indoor/outdoor carpet is made of synthetic fibers and backing materials that are specially formulated so that they are resistant to moisture. Most indoor/outdoor carpet will also be treated to resist fading from the sun or will be made from UV-resistant fibers. The backing 364 is preferably a mesh synthetic sheeting with adhesive coating 366 that binds the synthetic fiber piles 368 to the mesh. Note FIG. 8A. In an alternative, the piles 386 are made of synthetic strands from synthetic yarn with a mesh fabric backing 384 coated with adhesive material to securely join together the piles through and to the backing material.

The present invention is particularly useful for wearing at the beach. There you can simply shake out the sand or rinse them off with water and they will dry quickly allowing a clean footwear. They are also useful as for golf course, athletic facilities and throughout industry.

In one embodiment, I have worn the system of the present invention in the shower. This is done so I will not get fungus. Since it is sometimes difficult to bend over and scrub the bottom of my feet, I squirted soap on my footwear and scrubs my feet that way.

The carpet is glued directly onto the flip flop pad and one or three wholes are punched in allowing for the straps to be re-attached. The glues is made for items in the water and sun.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A footwear system comprising, in combination:

a pad having upper and lower surfaces, the pad having front, back, interior and exterior edges forming a pad periphery, the pad including a forward hole and an interior side hole and an exterior side hole for coupling with foot wear, the pad including carpet formed of a bottom layer of backing material and a top layer of pile, the forward hole extending rearwardly from the front edge, the interior side hole extending laterally from the interior edge, the exterior side hole extending laterally from the exterior edge.

2. The system as set forth in claim 1 wherein the bottom layer of backing material is a mesh of a plastic material and the top layer is a sheet of plastic with upstanding piles.

3. The system as set forth in claim 1 wherein the pile is medium pile with a length greater than 1.5 centimeters.

4. The system as set forth in claim 1 wherein the pile is short pile with a length not greater than 1.5 centimeters.

5. The system as set forth in claim 1 and further including:

a foot wear formed of a sole and an upper, the sole having an upper surface and a lower surface, a front edge, a back edge, an interior edge and an exterior edge, the interior edge having a first curved sole recess overlying the interior recess of the pad and located closer to the back edge than to the front edge, the exterior edge having a second curved sole recess closer to the back edge than to the front edge, the front, back, interior and exterior edges of the sole forming a sole periphery, the pad periphery overlying a majority of the sole periphery, the upper operatively coupled with respect to each sole, each upper formed of a forward component extending upwardly from the upper surface of the sole adjacent to the front edge, an interior component extending upwardly from the upper surface of the sole adjacent to the first minor recess, an exterior component extending upwardly from the upper surface of the sole adjacent to the second minor recess, the upper also including a first strap and a second strap, the first strap joining the front component with the interior component, the second strap joining the front component with the exterior component.

6. The system as set forth in claim 1 and further including:

a foot wear coupled to the pad, the foot wear formed of a sole and an upper, the sole having an upper surface and a lower surface, the sole also having a front edge, a back edge, an interior edge and an exterior edge, the front, back, interior and exterior edges of the sole forming a sole periphery, the upper operatively coupled with respect to the sole, overlying a majority of the sole periphery.

7. A footwear system (300) for permanently positioning and retaining padding upon upper surfaces of footwear soles for a wearer's sanitation and comfort, the positioning and retaining being done in a safe, convenient and economical manner, the system comprising, in combination:

a pair of soles, including a left sole (314) and a similarly configured right sole, each sole being fabricated of an elastomeric material chosen from the class of elastomeric materials including plastic and rubber, natural and synthetic, and blend thereof, each sole having a front edge (318), a back edge (320), an interior edge (322) and an exterior edge (324), each interior edge having a first curved sole recess (326) closer to the back edge than to the front edge with a first radius of curvature, each exterior edge having a second curved sole recess (328) closer to the back edge than to the front edge with a second radius of curvature, the front, back, interior and exterior edges of each sole forming a sole periphery, each sole having an upper surface (330) and a lower surface (332), each sole having a forward aperture located inwardly from the front edge, each sole having an interior side aperture located inwardly from the interior edge, each sole having an exterior side aperture located inwardly from the exterior edge;

an upper (334) operatively coupled with respect to each sole, each upper formed of a forward component (336) extending upwardly from the upper surface of the sole adjacent to the front edge, an inner component (338) extending upwardly from the upper surface of the sole adjacent to the first recess and an outer component (340) extending upwardly from the upper surface of the sole adjacent to the second recess, the upper also including a first strap (342) and a second strap (344), the first strap joining the front component with the interior component, the second strap joining the front component with the exterior component, the components and the straps being fabricated of an elastomeric material chosen from the class of elastomeric materials including plastic and rubber, natural and synthetic, and blend thereof, and a pad (348) fixedly positionable upon the upper surface of each sole, each pad having a front edge (350) and a back edge (352) positionable over the front edge and back edge respectively of an associated sole, each pad having an interior edge (354) and an exterior edge (356) positionable over the interior edge and exterior edge respectively of an associated sole, the front, back, interior and exterior edges of each pad forming a pad periphery entirely overlying the sole periphery and corresponding in size and share to the sole periphery, the pad formed with a forward hole (358) adjacent to the front edge of the pad overlying the forward aperture, the pad formed with an interior hole (360) adjacent to the interior edge of the pad overlying the interior side aperture, the pad formed with an exterior hole (362) adjacent to the exterior edge of the pad overlying the exterior side aperture, each hole having a diameter to receive the front, interior and exterior components respectively, the sole including a bottom layer (364) woven of an inextensible synthetic fabric with a top layer (366) fabricated of plastic and upstanding piles (368) the interior edge having a first curved pad recess (378) adjacent to the interior component with a third radius of curvature equal to the first radius of curvature, the exterior edge having a second curved pad recess (380) adjacent to the exterior component with a fourth radius of curvature equal to the second radius of curvature; and an adhesive (388) on the lower surface of the pad attaching the pad to the upper surface of the sole.

* * * * *